US008275311B2

(12) United States Patent
Lindman

(10) Patent No.: US 8,275,311 B2
(45) Date of Patent: Sep. 25, 2012

(54) METHOD IN CONNECTION WITH A WRIST DIVING COMPUTER AND A WRIST DIVING COMPUTER SYSTEM

(75) Inventor: Erik Lindman, Espoo (FI)

(73) Assignee: Suunto Oy, Vantaa (FI)

( * ) Notice: Subject to any disclaimer, the term of this patent is extended or adjusted under 35 U.S.C. 154(b) by 634 days.

(21) Appl. No.: 12/327,615

(22) Filed: Dec. 3, 2008

(65) Prior Publication Data

US 2010/0130123 A1 May 27, 2010

(30) Foreign Application Priority Data

Nov. 26, 2008 (FI) ..... 20086136

(51) Int. Cl.
*H04B 13/02* (2006.01)

(52) U.S. Cl. ..... 455/40; 455/77; 340/13.33

(58) Field of Classification Search ..... 455/40, 455/41.1, 41.2, 77, 95, 100, 120, 125, 151.2, 455/344

See application file for complete search history.

(56) References Cited

U.S. PATENT DOCUMENTS

| | | | | |
|---|---|---|---|---|
| 5,738,092 | A * | 4/1998 | Mock et al. | 128/205.23 |
| 7,388,512 | B1 * | 6/2008 | Moorer, Jr. | 340/850 |
| 2005/0254778 | A1 * | 11/2005 | Pettersen et al. | 386/46 |
| 2006/0277991 | A1 * | 12/2006 | Dahan | 73/299 |
| 2009/0208219 | A1 * | 8/2009 | Rhodes et al. | 455/40 |

* cited by examiner

*Primary Examiner* — Howard Williams

(57) ABSTRACT

The invention relates to a method and system in connection with a wristop diving computer (1). According to the method, at least the pressure of a gas bottle (2) is measured and the pressure data is transmitted under water using a low first frequency f1 to a wristop computer (1). According to the invention, on the surface of the water a second frequency f2, higher than the first frequency f1, is used for two-way telecommunications between the gas bottle (2) and the wristop computer (1).

28 Claims, 3 Drawing Sheets

METHOD IN CONNECTION WITH A WRIST DIVING COMPUTER AND A WRIST DIVING COMPUTER SYSTEM

The present invention relates to a method, according to the preamble of claim 1, in connection with a wristop diving computer.

The invention also relates to a wristop diving-computer system.

Thus, the invention relates to a device for displaying the sufficiency of respiratory air in compressed-gas apparatuses, such as diving apparatuses. Such devices are used by divers and firemen.

Under water, it is necessary to use in telecommunications a low frequency, for example, of 5.3 kHz, which in diving applications will travel in water the necessary distance of 1-2 m from a gas bottle to a wristop computer. In the technology of the sector, in addition to radio-frequency data transfer, the terms inductive, or magnetic-pulse transmission are used.

Wireless bottle-pressure data transfer is disclosed in, among others, U.S. Pat. Nos. 5,392,771 and 5,738,092 and EP patent 0550649. The same technology is also disclosed in FI patent 96380. Data-transfer technology for implementing wireless bottle-pressure data transfer is also disclosed in patent application FI 20031873.

It is not advantageous to transfer large amounts of data rapidly using a low-frequency electromagnetic signal. In addition, in a typical solution, the magnetic-pulse transmission technique consumes a great deal of power.

A drawback of the prior art described in the US publications is that long bit strings cannot be transferred rapidly using low power. In order to save power, the data must be transmitted infrequently, which in turn leads to a reduction in the real-time nature of the bottle-pressure display.

The technology disclosed in the aforementioned Finnish publication permits a reasonably rapid data transfer at a low current consumption, which can be repeated frequently without using a great deal of energy. A drawback with this technology is that it does not permit a very large number of identifiers, which fully individuate all the transmitters, as disclosed in EP publication 0550648. The number of identifiers according to the FI publications is large, but not, however, fully individuating, as required when measuring a respiratory gas.

In the applicant's present solution, the identifier selected by the user is checked and compared with the identifiers of the other users, in order to be certain that in a diving situation, for example, there is no confusion between the identifiers. If the bottle identifier must be changed, the user must do this manually. Communication to the transmission component is handled clumsily, by manually manipulating the measured pressure.

The present invention is intended to eliminate the defects of the state of the art disclosed above and for this purpose create an entirely new type of solution.

The invention is based on using two different data-transfer frequencies, according to whether one is on or below the surface of the water.

The identifiers of the lower frequency are preferably set with the aid of the higher frequency.

According to one preferred embodiment of the invention, a pressure detector is used for the change of frequency.

According to a second preferred embodiment of the invention, a resistivity sensor is used for the change of frequency.

According to a third preferred embodiment of the invention, detection of the second frequency is used for the change of frequency.

More specifically, the method according to the invention is characterized by what is stated in the characterizing portion of claim 1.

For its part, the system according to the invention is characterized by what is stated in the characterizing portions of claims 8 and 15.

Considerable advantages are gained with the aid of the invention. By using two frequencies, an optimal situation is achieved in terms of data transfer. Checking operations, which require a great deal of information, to ensure and determine the correct wristop computer/bottle pair, can be implemented above water. By means of a higher frequency, it is easy to implement the data transfer to be two-way, so that the power consumption particularly in the wristop computer will remain reasonable.

Using the existing technology, for example, the implementation of multi-gas diving using several transmitters is possible, but its practical arrangement is difficult. The invention permits wireless real-time measurement of the sufficiency of respiratory gases for all gases in multi-gas diving.

In the following, the invention is examined with the aid of examples of applications according to the accompanying drawings.

Figure 4A:
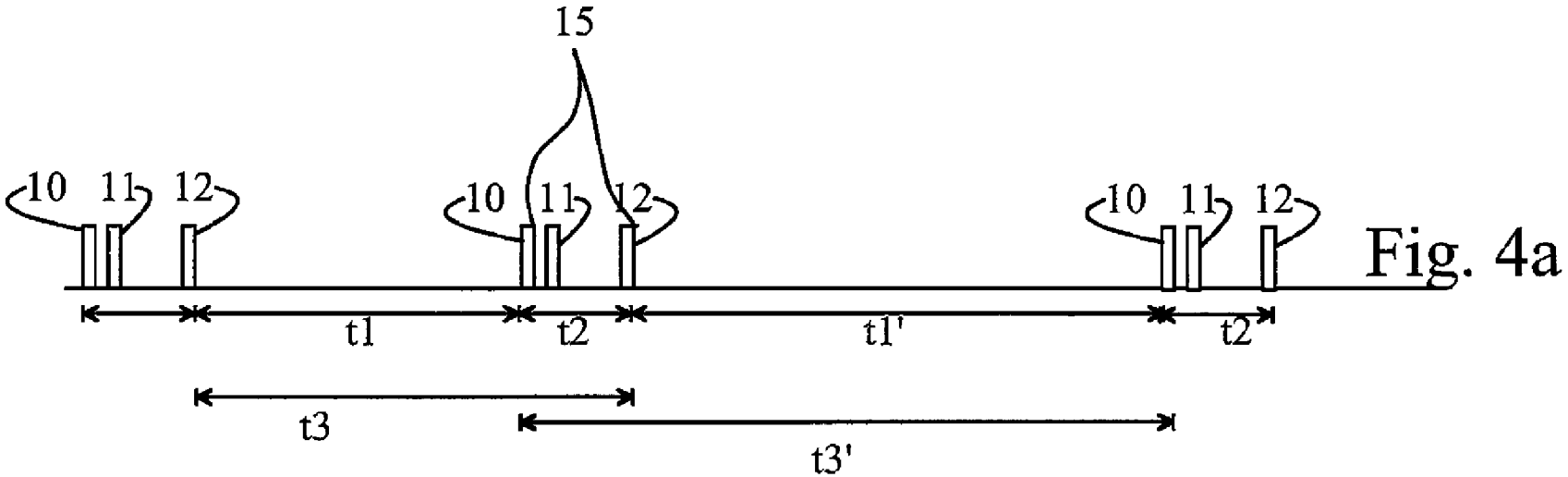
Figure 4B:
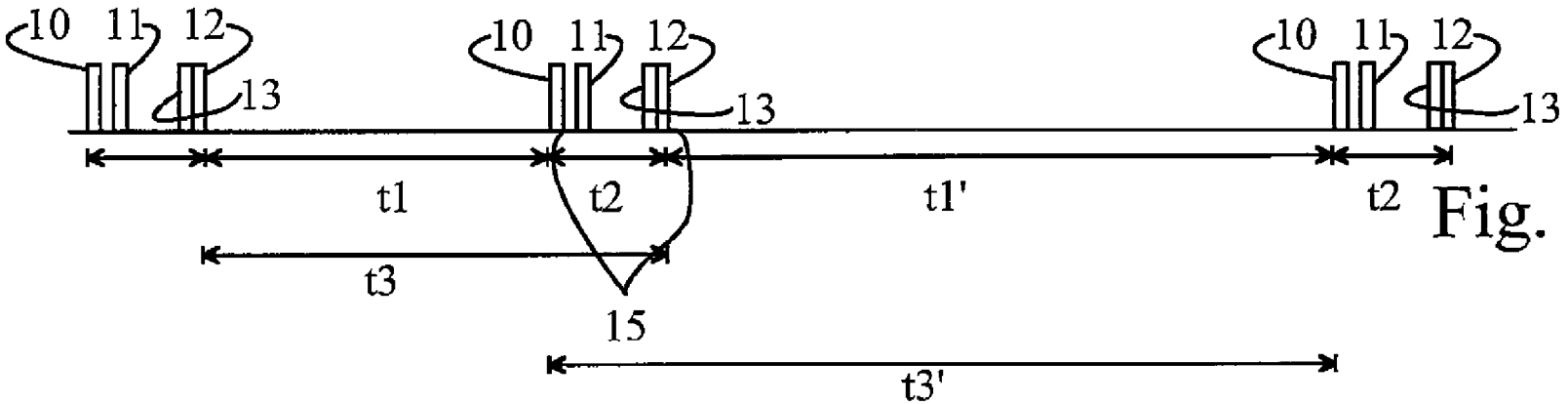

FIGS. 4*a* and 4*b* show pulse diagrams of one possibility of implementing data communications in the solution according to the invention.

Figure 1:
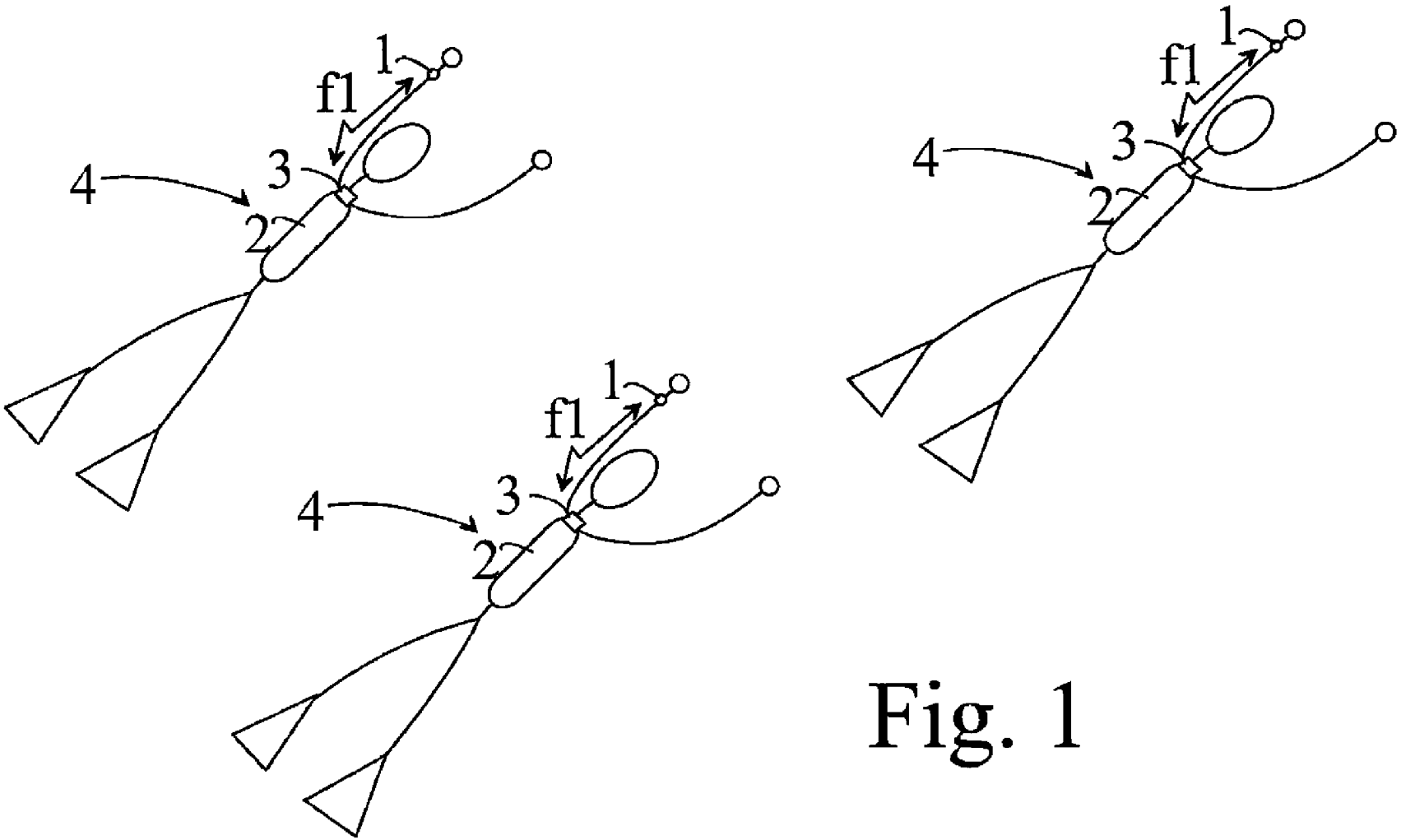
FIG. 1 shows schematically the environment according to the prior art, to which the invention can be applied.

According to FIG. 1, during a dive the diver 4 has available a telecommunications link using the frequency f1 between the telecommunications unit 3 of the pressure bottle 2 and the wristop computer 1. Because during a dive the transfer path is water, the frequency f1 is typically 5.3 kHz, so that the electromagnetic energy will travel as far as possible. In this situation, the data traffic is generally one-way, and from the telecommunications unit of the gas bottle 2 to the wristop computer. For divers 4, who move typically in pairs but also in groups, to receive data reliably on the pressure in only their own bottle 2, it must be ensured diver-specifically 4 that the wristop computer 1 and the corresponding gas bottle 4 including its telecommunication unit form an unequivocal pair. This is essential, because if the wristop computer 1 receives data from the telecommunications unit 3 of the gas bottle 2 of a neighbouring diver, erroneous interpretations of the amount of gas available can arise. In the present application, the term low frequency refers to a frequency of less than 1 MHz.

Figure 2:
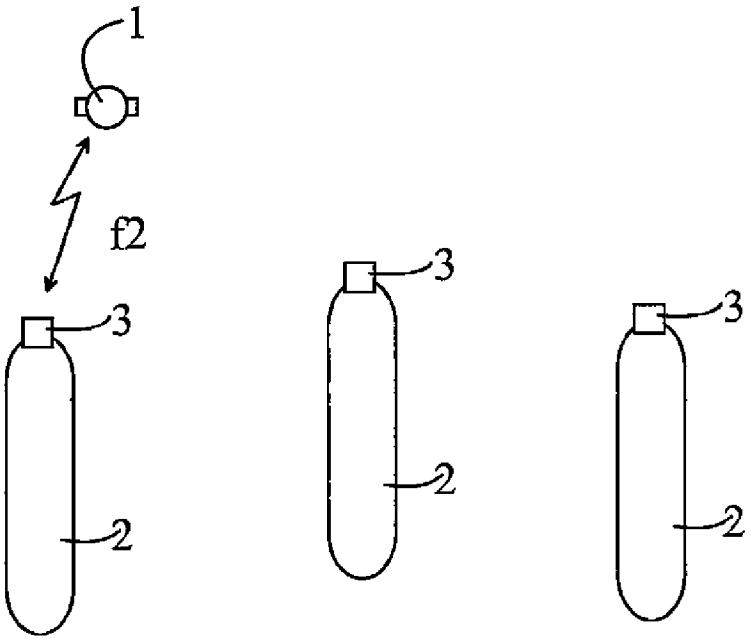
FIG. 2 shows schematically a system assembly according to the invention.

According to FIG. 2, a second, higher frequency f2, the faster transfer of which permits many new checks improving safety to be made, is used in the invention, for the aforementioned unequivocal linking of the wristop computer 1 and the gas bottle 2 to each other. Thus, the frequency f2 is used when air is the medium between the gas bottle 2 and the wristop computer 1. With the aid of data-transfer protocols that are, as such, known, the connection above water can be made two-way at the above-water frequency f2, in which case many check routines can be implemented between the wristop computer 1 and the gas-bottle unit, to ensure the unequivocalness of the wristop computer 1/gas bottle 2 pair. The term high frequency f2 refers in the invention to a frequency higher than 1 MHz.

Figure 3:
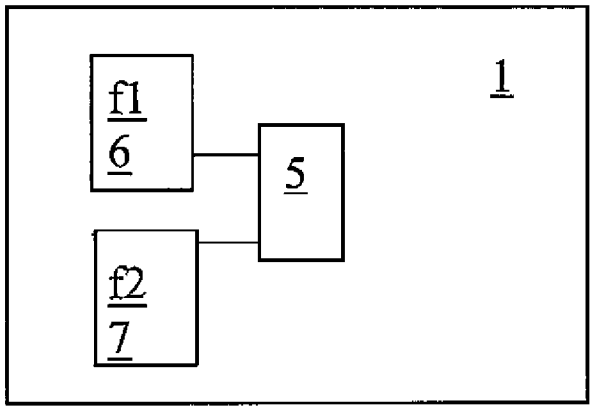
FIG. 3 shows a wristop-computer component according to the invention.

According to FIG. 3, the wristop computer 1 comprises, among other things, a central unit 5 with a low-frequency f1 receiver 6 connected to it, in which, within the scope of the invention, there can also be a transmitter unit. According to the invention, the wristop computer 1, like the telecommunications unit 3 of the bottle unit 2 also correspondingly shown in FIG. 2, is equipped with a two-way transceiver 7, which is switched on to operate after a dive, for example, by means of a pressure or conductivity sensor of the wristop computer.

The block diagram according to FIG. 3 is close to the block diagram according to the invention of the gas-bottle transmitter, with the difference, however, that instead of the low-frequency f1 receiver element 6, in the gas-bottle transmitter 3 there is a low-frequency transmitter element.

The frequency f2 can be, for example, the 2.45 GHz reserved for the ANT or Bluetooth protocol. Both of the aforementioned protocols are suitable for implementing a transceiver 12, but the ANT protocol is particularly advantageous on account of its low power consumption. Due especially to the wristop computer 1, a low power consumption is a very critical factor, so that the diver's safety will not be endangered due to the battery emptying.

With the aid of the invention, the gas-bottle transmitter 3 can be individuated, for example, by means of a series number. The bottle transmitter's 3 information can be stored in the memory of the wristop receiver (wristop computer) 1. Operating purposes, for example for multi-gas situations, can also be set for the bottle transmitter 3, in which case the system can be equipped with a separate transmitter 3 for a different respiratory gas. Markings on the case of the transmitter 3, such as a series number and a separate mark, number, or colour code on the case of the transmitter, can be combined with this information packet, to ensure the installation of the correct transmitter 3 on the correct respiratory-gas tank 2. The memory of the transmitter 3 can contain information on the series number, case markings, operating data for the transmitter, for example, the number of operating hours, and the number of operating hours after a battery change. It can also be advantageous to record temperature data in the memory of the transmitter 3. Naturally, monitoring of respiratory-gas pressure can also be recorded in the transmitter 3, though the custom has been for these data to be recorded in the receiver 1. All the data in the memory can easily be queried and transmitted with the aid of fast high-frequency radio traffic, when the respiratory-gas operation is not switched on, for example, before or after diving.

In the solution according to the invention, the existing Vytec-type inductive data transfer is used under water, and on the surface before diving or in some other situation that breaks the connection, high-frequency two-way traffic permitting a large amount of data to be transmitted energy-economically is used in addition.

The following presents a summary of the features of the invention:

1. The actual low-frequency (f1) data transfer operates in water and in firefighting situations.

2. It is possible (on the surface or before a situation) to select and set the low-frequency transmission (f1) channel (code) using two-way high-frequency communication f2. The present code-changing commands made using pressure can be omitted.

3. On the ANT-protocol side, identifiers that fully identify the gas-bottle transmitters 3 can be used. Under water, it is possible to use the low-frequency (f1) channel systems presently in operation can be used, which has proven very good compared to bit-string data transfer, which, due to its infrequent update frequency, detracts from the real-time nature of the measurement.

4. Using the ANT frequency, it is possible to communicate with other device users (for example, those in a boat or a firefighting group) and to set automatically or semiautomatically specific low-frequency channels for all of them, for the frequency f1. The high frequency f2 is required for range and the amount of data transfer, using a low-frequency f2 system, for example, at 5 kHz, this operation will not succeed.

5. When the high-frequency connection returns again, larger amounts of other data can also be transferred from the bottle-pressure transmitter and a dive profile, for example, can be attached. For example, it may be possible to obtain the temperature better from the transmitter than from the wrist, at least in fires. Battery voltage can be one of the data transferred using the high frequency f2, as can respiratory frequency and amount.

6. The invention permits a sensible implementation for gas changes, using several transmitters 3, as we automate the coding over several transmitters on the surface.

7. The invention can further be combined with the heart-rate data, a channel be set for this purpose using the device and can then operate at least under a dry suit.

The low-frequency f1 (e.g., Vytec) data-transfer system of FIG. 1 operates, for example, as follows:

In the transmitter 3 there is a pressure sensor, which has an analog voltage output. The pressure signal is amplified and converted to digital form. The processor processes the pressure information into a time-interval format. In addition, on the basis of the memory information, the processor creates two detection time intervals. The processor commands the transmitter circuit to transmit magnetic pulses. The resonance frequency in the pulses is 5.3 kHz and the pulses themselves do not contain information.

The pulse totality is transmitted in such a way that each totality consists of one pressure time interval and two detection time intervals.

The codes are rounded off to integers and 40 different codes are permitted in a typical application.

According to FIG. 4*a*, the transmitted signal can comprise, for example, 2 repeating time periods, time period t1 and time period t2, of which time period t1 contains the actual measured information, either directly as the length of the time period, or proportional to this length. In heart-rate-measurement applications, t1 is either directly the time between heartbeats, or a time proportional to it. For example, in a pressure-measuring application, t1 can also be a time period proportional to the pressure (oxygen-bottle pressure, or blood pressure). The time period t2, for its part, contains the identifier code of the signal, a codeword 15, and a starting bit 10, which, according to the invention, is a pulse containing power, with a digital value of 1.

After this follows the desired number of code pulses (bits) as the codeword 15. The pulse 11 is the second and the pulse 12 the eighth bit in the codeword 15 in question. The number of code bits (=codeword length) can naturally be greater or smaller, however, the number of bits in the codeword 15 typically varies between 4 and 128. Thus, during the pulses 11 and 12, the transmission power of the transmitter is on and during the time between these 1-bits the transmission power is not used.

Thus, in the solution of FIG. 4*a*, in an eight-bit codeword the transmission power is on for 25% of the duration of the code. In the case of power consumption, the same principle naturally holds for the time period t1 between the pulses 10 and 12, which represents analog data. Thus, transmission power is not consumed at all during the time interval t1. Thus, t1 can contain, as an analog value, information on, for example, heart rate, the interval between heartbeats, gas-bottle pressure, pedalling cadence, blood pressure, or speed. Thus, at the receiver end, t1 is converted into information depicting the variable being measured, be defining the time interval t1 as an analog variable, for example, with the aid of a gate circuit, during the time between the pulses 10 and 12.

In FIG. 4*a*, the first time periods t1 and t2 are followed by second time periods t1' and t2, of which t1' is longer than the time period t1.

FIG. 4*b*, for its part, shows a second alternative of the solution according to the invention. In this case, three bits in a 1 state, which depict the pulses 11, 12, and 13, are used in the time period t2. In the solution of FIG. 2*b*, during the codeword 15, the transmission power is on for 37.5% of the duration of the codeword.

In measurement, the pressure data typically has values in the range 10-360 bar.

In measurement, it is also possible to use the following values depicting special situations.

5 bar=transmitter processor has measured a low battery voltage, the symbol 'LOBT' is shown on the display of the wristop computer 1.

7 bar=outside the measurement range, e.g., more than 360 bar, '- - -' is shown on the display.

365 bar=tank empty, pressure in the range 0-9.99, 0 bar is shown on the display when diving and the code is reset on the surface, because the tank is empty.

The transmitter switches off, if the tank is empty, or the pressure does not change (bottle not in use). The transmitter switches on again when the pressure changes and if the pressure is more than 15 bar. If switching on again takes place with an empty tank, the transmitter should be recoded.

A change of frequency from the first frequency f1 to the second frequency f2 and vice versa can take place, for example, with the aid of a pressure switch, in which case an increase in pressure above a specific limit will change the operation to the first, lower frequency f1. An increase in pressure over the same limit correspondingly changes the operation back to the second frequency range f2.

Alternatively, in the wristop computer there can be a resistivity sensor, a drop in the measurement value of which to below a predefined limit value can correspondingly change the operation to the first, lower frequency f1. An increase in resistivity above the same limit value correspondingly changes the operation back to the second frequency range f2.

The frequency selection can also be based on the detection of frequency. If, at the diving location, the higher telecommunications frequency f2 is present, for example, for maintenance measures, the wristop computer can detect that it is on the surface purely from the presence of the frequency in question, and start communication with the gas bottle at the frequency f2. Naturally, combinations of all of the aforementioned ways are possible.

In the gas-bottle part 2, it is possible to keep both frequencies f1 and f2 switched on whenever pressure is being measured in the bottle. The bottle part 2 need not known if it is in water and the different-frequency radio circuits or transmitter circuits are, in this sense, independent of each other. On the other hand, the bottle part 2 can be set to transmit at the high frequency f2 only if the wristop computer 1 has requested this. According to the invention, a protocol can also be created for the system, which switches off the low-frequency transmission f1 when there is outgoing communication at the high frequency, so that disturbances, for example inside the device, are eliminated in this case. The bottle part 2 can listen to the high-frequency channel f2 at all times, and at least at times when the low-frequency transmission f1 is not in use it will be easy to receive the high frequency f2 coming from the wristop computer 1. Indeed, the wristop computer 1 is also able to monitor these silent windows from the low-frequency transmission f1, so that it will get its message timed in such a way that it will reach its destination.

The wristop computer 1 also has a series number. The gas-bottle unit 2 can also be set to accept high-frequency instructions from a specific wristop device. In that case, for example, the removal of the battery can wipe out this setting.

According to the invention, the higher frequency f2 can be used by both the bottle-pressure units 2, 3 and the diving computer 1, the data in the memories can also be transferred to a computer or, for example, mobile telephone for further processing and/or collecting statistics.

At the higher frequency f2, it is possible not only to make diving-gas data but especially to set low-frequency identifiers for the diving computer 1 and the bottle-pressure transmitter 3, not only from the diving computer 1, but also, for example, from a computer. According to the invention, a property can be added to the program controlling the diving computers 1 and their data transfer, by means of which it is possible from the computer to set, at the frequency f2, both the diving computers 1 and the bottle-pressure transmitters 3 ready for diving when making the diving plan. The same can naturally also be applied to a mobile station.

The invention claimed is:

1. A method in connection with a wristop diving computer for use by a diver, the method including the steps of:

measuring at least the pressure of a gas-bottle;

transmitting the pressure data under water at a low first frequency f1 to the wristop computer; and using on the surface of the water a second frequency f2 that is higher than the first frequency f1 for two-way telecommunications between the gas bottle and the wristop computer.

2. The method according to claim 1, wherein the frequency is selected on the basis of the ambient pressure.

3. The method according to claim 2, wherein the frequency is selected on the basis of resistivity data.

4. The method according to claim 1, wherein the frequency is selected on the basis of resistivity data.

5. The method according to claim 1, wherein the second frequency is selected, if its presence is detected.

6. The method according to claim 5, wherein the low frequency f1 is damped, if high-frequency f2 traffic is detected.

7. The method according to claim 1, wherein the low frequency f1 is damped, if high-frequency f2 traffic is detected.

8. The method according to claim 1, wherein high-frequency communication is permitted between two wristop computers.

9. The method according to claim 1, wherein high-frequency communication is used between the gas bottle or the wristop computer, and a peripheral device.

10. The method according to claim 9, wherein the peripheral device is a computer or a mobile station.

11. The method according to claim 1, further comprising the step of measuring heart rate data of the diver.

12. A wristop diving computer system configured for operation above and below the surface of a body of water, the system comprising:

a central unit;

a telecommunications element operably coupled to the central unit, the telecommunications element configured to receive a first electromagnetic frequency f1 at least when below the surface of the water; and a telecommunications transceiver operably coupled to the central unit and configured to operate at a second frequency f2, higher than the first frequency f1, in two directions, particularly for telecommunications taking place above water.

13. The system according to claim 12, further comprising a pressure sensor coupled to the central unit, wherein the central unit is configured to change between the first and second frequencies based upon ambient pressure.

14. The system according to claim 12, further comprising a conductivity sensor coupled to the central unit, wherein the central unit is configured to change between the first and second frequencies based upon the resistivity of the communication medium.

15. The system according to claim 12 wherein the control unit is configured to detect frequency and, upon sensing the second frequency, changing from operating under the first frequency to operating under the second frequency.

16. The system according to claim 15, wherein the central unit is configured to dampen the low frequency f1, if high-frequency f2 traffic is detected.

17. The system according to claim 12, wherein the central unit is configured to dampen the low frequency f1, if high-frequency f2 traffic is detected.

18. The system according to claim 12, wherein the central unit is configured to permit high-frequency communication f2 between two wristop computers.

19. The system according to claim 12, further comprising a telecommunications element coupled to the gas bottle, and wherein the system is configured to provide it high-frequency communication f2 between the telecommunications element of the gas bottle or wristop computer and a peripheral device.

20. The system according to claim 19, wherein the peripheral device is a computer or a mobile station.

21. The system of claim 12, wherein at least one of the first and second frequencies further include a transmitted signal representative of heart rate data.

22. A telecommunications device for communicating the pressure within at least one gas bottle above or below the surface of a body of water, the device comprising:

a central unit;

a telecommunications element operably coupled to the central unit, the telecommunications element configured to transmitting a first frequency f1 at least when below the surface of the water; and a telecommunications transceiver operably coupled to the central unit and configured to operate at a second frequency f2, higher than the first frequency f1, in two directions, particularly for telecommunications taking place above water.

23. The device according to claim 22, further comprising a pressure sensor coupled to the central unit, wherein the central unit is configured to change between the first and second frequencies based upon ambient pressure.

24. The device according to claim 22, further comprising a conductivity sensor coupled to the central unit, wherein the central unit is configured to change between the first and second frequencies based upon the resistivity of the communication medium.

25. The device according to claim 22, wherein the control unit is configured to detect frequency and, upon sensing the second frequency, changing from operating under the first frequency to operating under the second frequency.

26. The device according to claim 22, wherein the central unit is configured to dampen the low frequency f1, if high-frequency f2 traffic is detected.

27. The device according to claim 22, wherein the central unit is configured to permit high-frequency communication f2 between two wristop computers.

28. The device of claim 22, wherein at least one of the first and second frequencies further include a transmitted signal representative of heart rate data.

* * * * *